US007938669B2

(12) United States Patent
Li et al.

(10) Patent No.: US 7,938,669 B2
(45) Date of Patent: May 10, 2011

(54) CABLE ASSEMBLY WITH LATCHING MECHANISM

(75) Inventors: Dong-Sheng Li, Kunshan (CN); Su-Feng Liu, Kunshan (CN); Bin Xu, Kunshan (CN); Chin-Te Lai, Tu-Cheng (TW)

(73) Assignee: Hon Hai Precision Ind. Co. Ltd., New Taipei (TW)

( * ) Notice: Subject to any disclaimer, the term of this patent is extended or adjusted under 35 U.S.C. 154(b) by 0 days.

(21) Appl. No.: 12/701,606

(22) Filed: Feb. 8, 2010

(65) Prior Publication Data

US 2010/0203754 A1 Aug. 12, 2010

(30) Foreign Application Priority Data

Feb. 7, 2009 (CN) ..... 2009 2 0300479 U

(51) Int. Cl.
*H01R 13/62* (2006.01)

(52) U.S. Cl. ..... 439/352

(58) Field of Classification Search ..... 439/352, 439/357, 358

See application file for complete search history.

(56) References Cited

U.S. PATENT DOCUMENTS

| | | | | |
|---|---|---|---|---|
| 7,114,980 | B1 * | 10/2006 | Wu | 439/352 |
| 7,134,914 | B1 | 11/2006 | Wu | |
| 7,160,135 | B1 * | 1/2007 | Wu | 439/352 |
| 7,226,316 | B2 * | 6/2007 | Wu | 439/607.44 |
| 7,238,040 | B1 * | 7/2007 | Wu | 439/352 |
| 7,281,937 | B2 * | 10/2007 | Reed et al. | 439/352 |
| 7,473,124 | B1 * | 1/2009 | Briant et al. | 439/352 |
| 7,540,755 | B1 * | 6/2009 | Wu | 439/352 |
| 7,572,138 | B1 * | 8/2009 | Wu | 439/352 |
| 7,666,023 | B2 * | 2/2010 | Wu | 439/352 |
| 2005/0233631 | A1 * | 10/2005 | Wu | 439/352 |
| 2007/0161281 | A1 * | 7/2007 | Wu | 439/352 |
| 2008/0032841 | A1 * | 2/2008 | Oishi et al. | 474/242 |

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

A cable assembly (100), comprises a housing (10) formed by a base portion (101) having a first top surface (1011) and a mating portion (102) having a second top surface (1021), and the housing has a receiving space therein. A plurality of conductive contacts (311, 331) are retained in the housing. A cable (7) is entered into the receiving space and electrically connected with the conductive contacts. A pulling member (52) is moveable relative to the housing in a horizontal direction, and comprises a cooperating portion (524) at a front end thereof. And a latching member (51) is cooperated with the pulling member and assembled to the housing for latching with a complementary connector. The latching member comprises an engaging section (513) assembled to the housing, a latching section (515) disposed on the top of the base portion and an actuating section (5140) disposed between the engaging section and the latching section. The actuating section is interconnected with the cooperating portion and capable of being actuated by the cooperating portion of the pulling member.

20 Claims, 6 Drawing Sheets

CABLE ASSEMBLY WITH LATCHING MECHANISM

FIELD OF THE INVENTION

The present invention generally relates to a cable assembly, and more particularly to a cable assembly with a new latching mechanism.

DESCRIPTION OF PRIOR ART

PCI Express, officially abbreviated as PCI-E or PCIe, is a computer expansion card interface format introduced by Intel in 2004. It was designed to replace the general-purpose PCI expansion bus, the high-end PCI-X bus and the AGP graphics card interface. Unlike previous PC expansion interfaces, rather than being merely a bus, it is configured around point-to-point full duplex serial links called lanes. In PCIe 1.1 (the most common version as of 2007) each lane carries 250 MB/s in each direction.

PCI Express External Cabling which extends the PCI Express interconnects architecture "outside the box." Cables using the PCIe technology will be used for external applications, as well as applications internal to an enclosure that need a cable connection. PCI Express External Cabling Specification, REV. 1.0 introduced four kinds of cable assemblies x1, x4, x8 and x16, and among which the x16 cable assembly may reach highest transmitting rate. The x16 cable assembly includes a housing, a pair of stacked PCBs accommodated in a space of the housing and four cables terminated to corresponding the PCBs.

U.S. Pat. No. 7,134,914 B1 discloses a cable assembly having a latch and an actuator cooperated with each other, the actuator has a front end disposed below the latch for actuating a portion of the latch on the top of the front end of the actuator. When the actuator is moved rearward by a pulling force, a front end of the latch is raised up. However, the front end of the latch can not be resumed to an original state automatically when the pulling force is removed, obviously, additional operation should be effected on the latch to make it resume to the original state. So the cable assembly can not latch with the complementary connector conveniently.

Hence, an improved cable assembly is highly desired to overcome the aforementioned problems.

SUMMARY OF THE INVENTION

Accordingly, an object of the present invention is to provide a cable assembly having a latching mechanism including an pulling member and a latching member cooperated with the pulling member, and an interconnection between the pulling member and the latching member is reliable and simple.

In order to achieve the object set forth, a cable assembly in accordance with the present invention comprises a housing formed by a base portion having a first top surface and a mating portion having a second top surface, and the housing has a receiving space therein. A plurality of conductive contacts are retained in the housing. A cable is entered into the receiving space and electrically connected with the conductive contacts. A pulling member is moveable relative to the housing in a horizontal direction, and comprises a cooperating portion at a front end thereof. And a latching member is cooperated with the pulling member and assembled to the housing for latching with a complementary connector. The latching member comprises an engaging section assembled to the housing, a latching section disposed on the top of the base portion and an actuating section disposed between the engaging section and the latching section. The actuating section is interconnected with the cooperating portion and capable of being actuated by the cooperating portion of the pulling member.

Other objects, advantages and novel features of the invention will become more apparent from the following detailed description when taken in conjunction with the accompanying drawings.

DETAILED DESCRIPTION OF PREFERRED EMBODIMENTS

Figure 1:
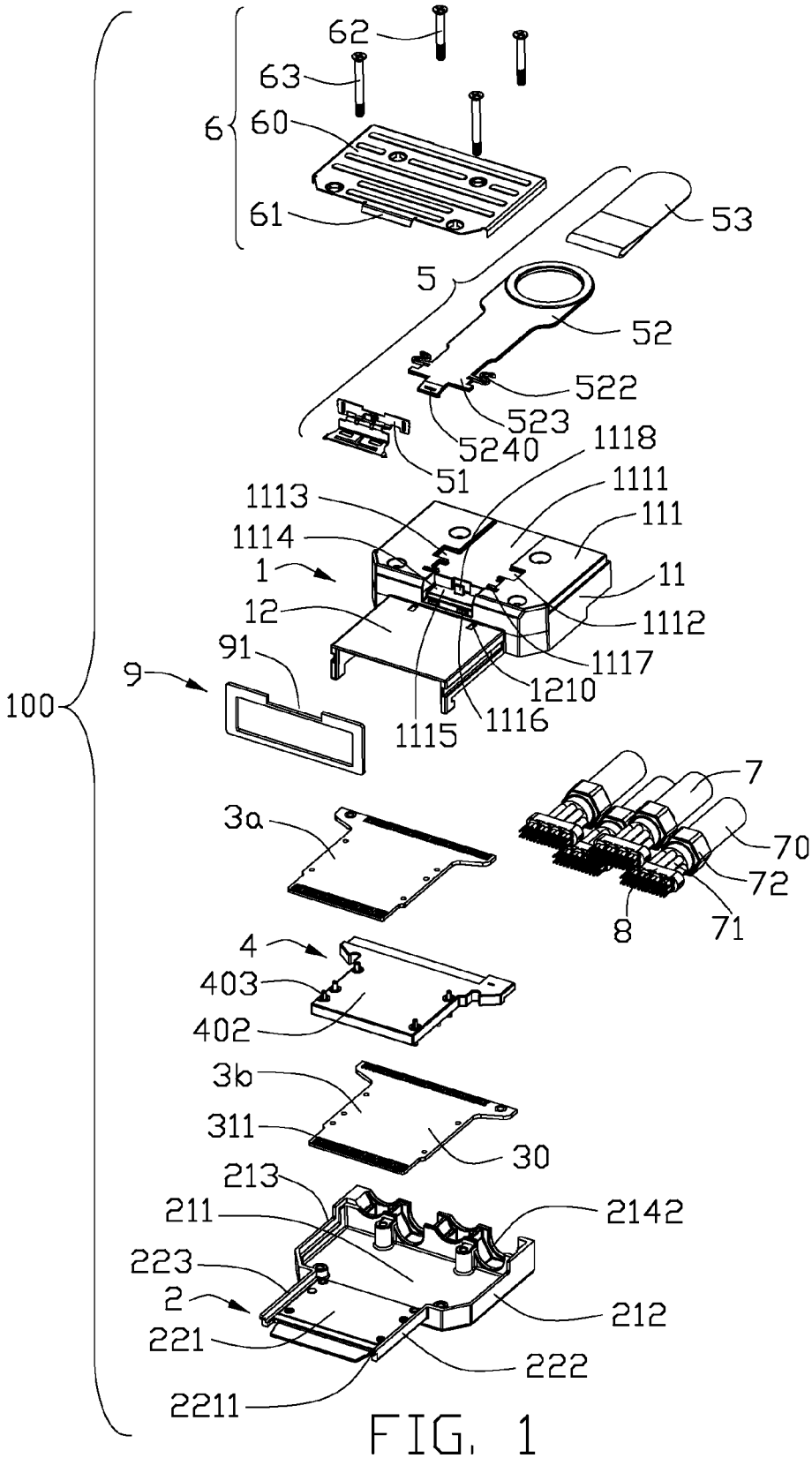
FIG. 1 is an exploded, perspective view of a cable assembly in accordance with the present invention.

Reference will now be made in detail to the preferred embodiment of the present invention.

Referring to FIGS. 1 to 6, a cable assembly 100 in accordance with the present invention comprises a housing 10 having an upper first shield part 1 and a lower second shield part 2 together enclosing a receiving space (not numbered) therein, a pair of printed circuit boards (PCBs) 3 received in the receiving space, a spacer 4 interposed between the pair of the printed circuit boards 3, four cables 7 coupled to the pair of PCBs 3 and a latching mechanism 5 assembled to the housing 10. The housing 10 defines a base portion 101 having a first top surface 1011 and a mating portion 102 having a second top surface 1021. The mating portion 102 extends forwardly form the base portion 101, and the mating portion 102 is smaller than the base portion 101.

Figure 2:
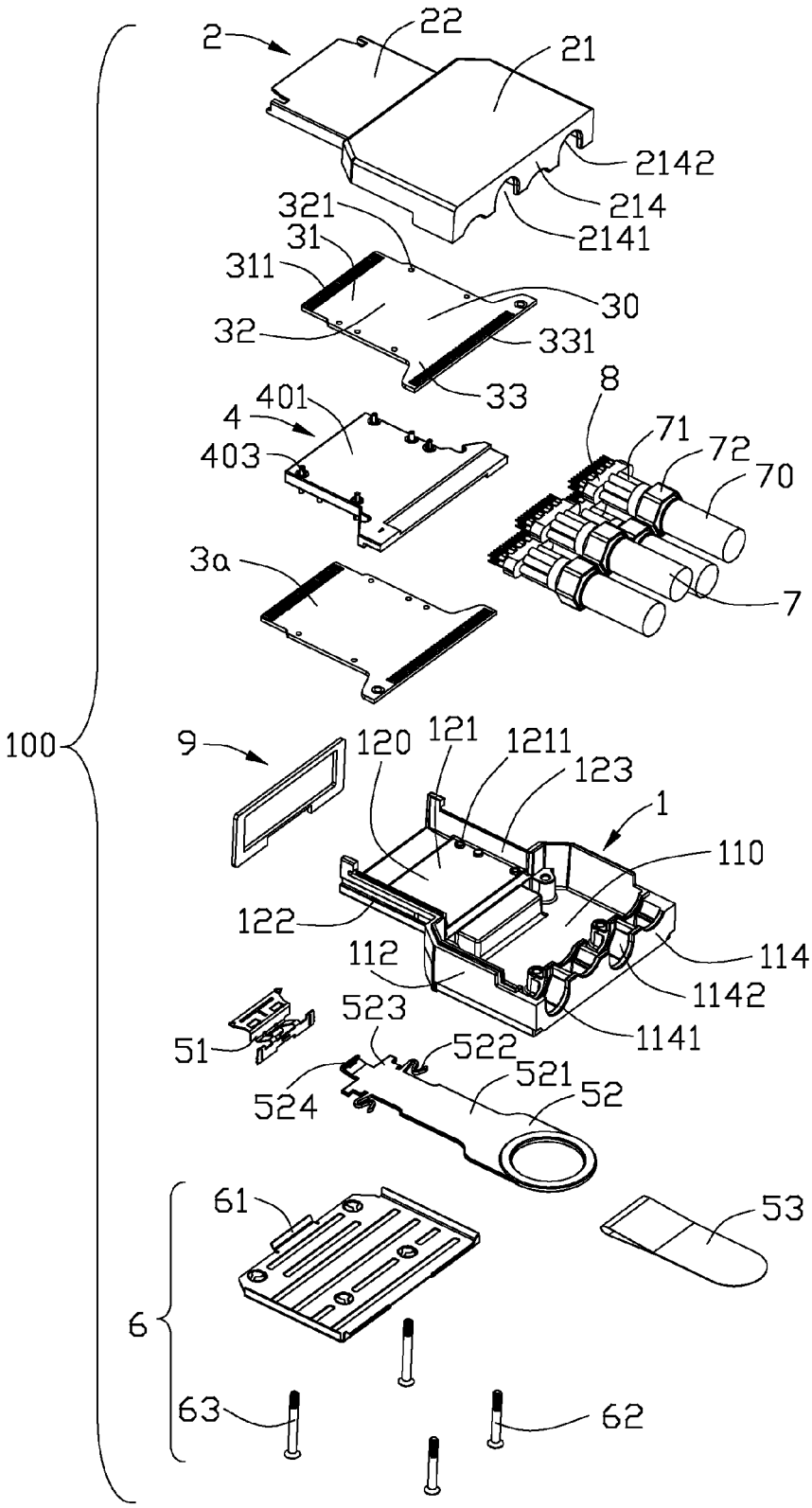
FIG. 2 is similar to FIG. 1, but viewed from another aspect.
Figure 3:
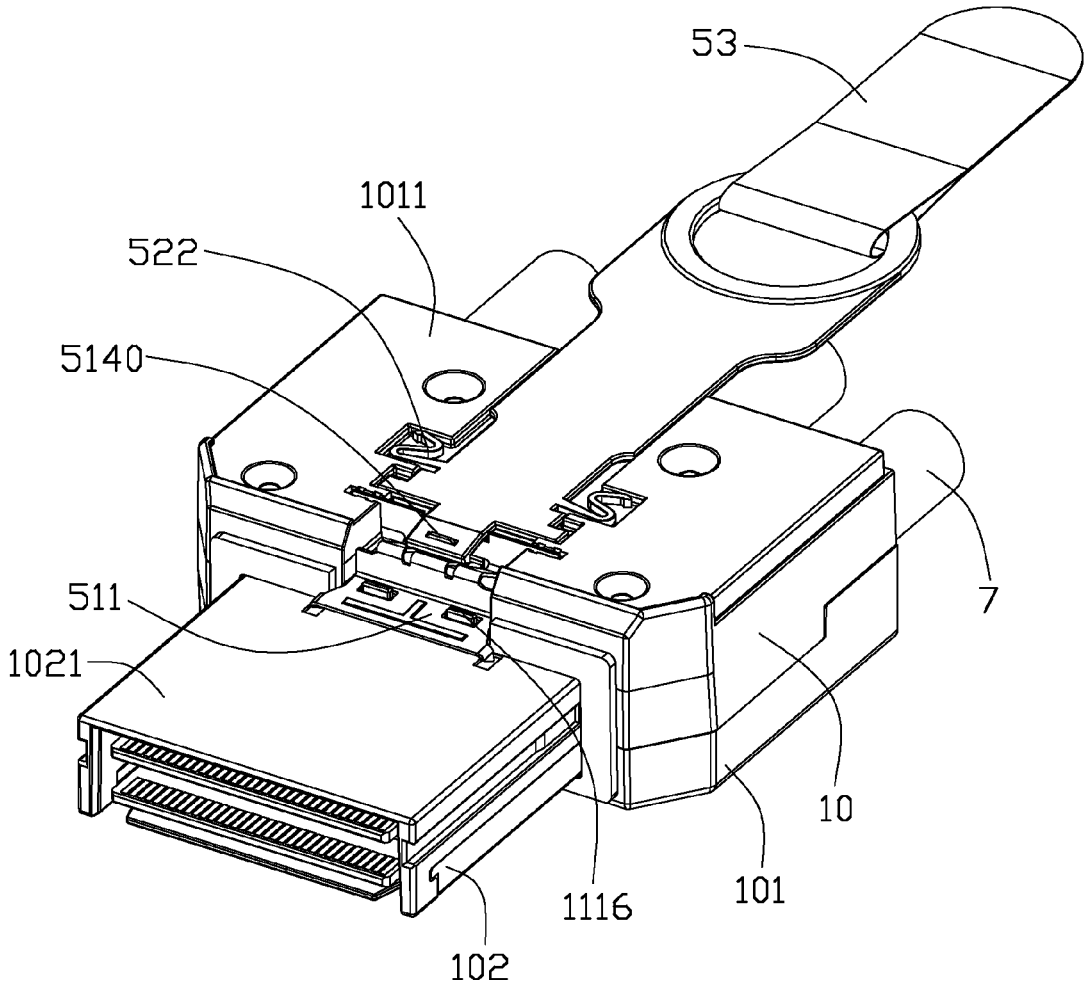
FIG. 3 is an assembled, perspective view of the cable assembly without a conductive shell.
Figure 4:
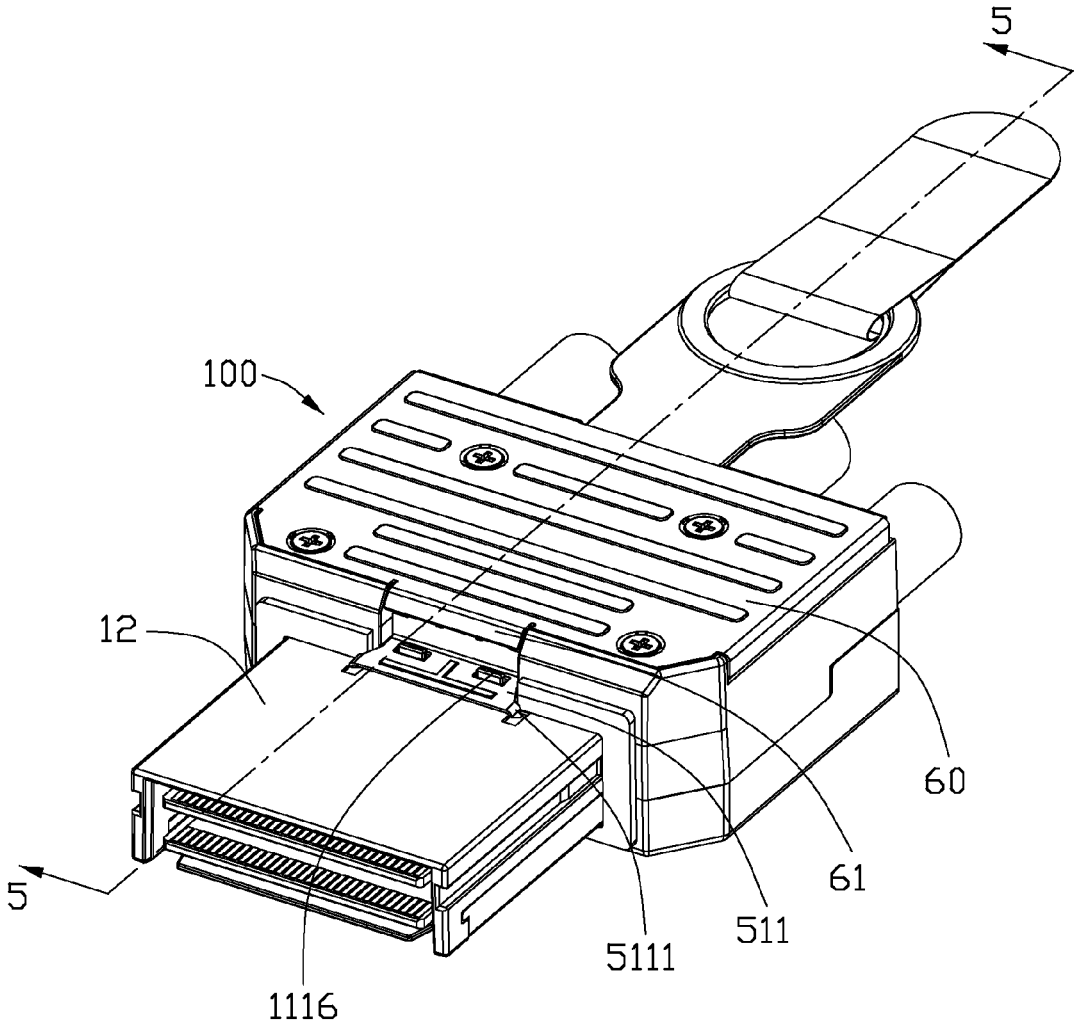
FIG. 4 is an assembled, perspective view of the cable assembly.
Figure 5:
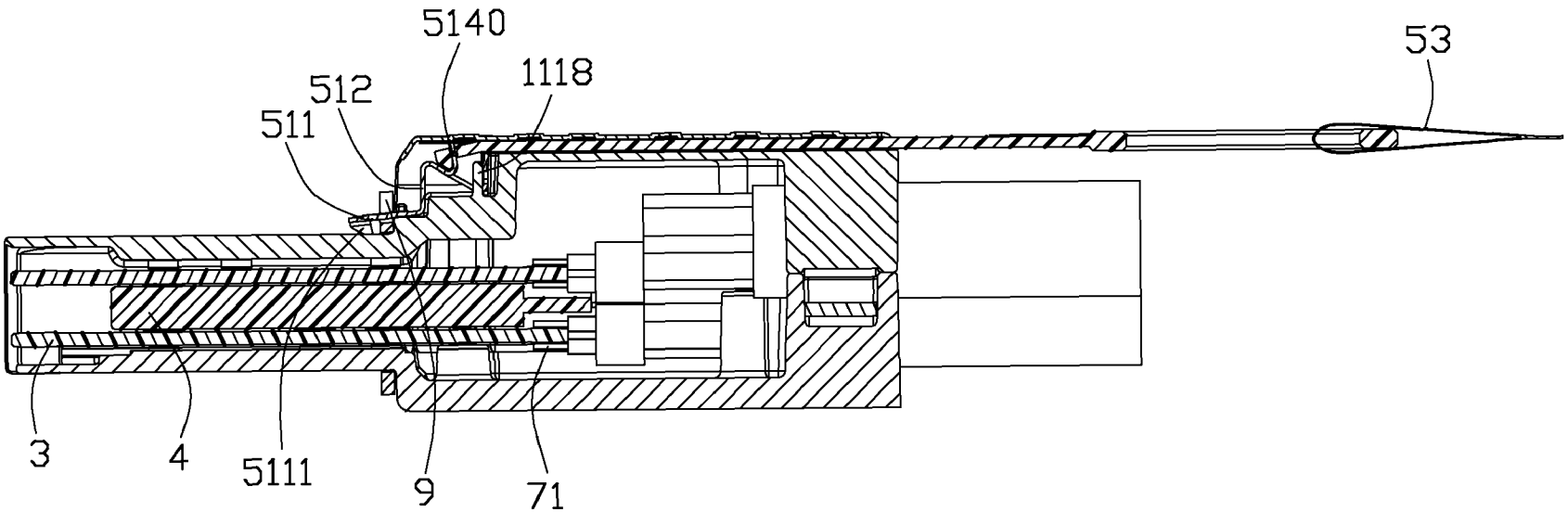
FIG. 5 is a cross-section view taken along line 5-5 of FIG. 4.

Referring to FIGS. 1 to 3, the first shield part 1 comprises an expanded first base portion 11 and a relative slim first mating portion 12 extending forwardly from a front edge of the first base portion 11. The first base portion 11 has a top wall 111, a pair of side walls 112, 113 and a rear wall 114 forming a hollow portion 110. Four semicircular through holes 1141 extending in a front to rear direction are defined in the rear wall 114 and arranged in a row along transversal direction. Further, a recess 1142 is formed in each through hole 1141. The first mating portion 12 has a top side 121 and a pair of transversal sides 122, 123 extending downward from two edges of the top side 121. A mating port 120 is formed by the top side 121 and a pair of transversal sides 122, 123, and located in front of and communicating with the hollow portion 110. Two pair of first supporting posts 1211 are spaced apart each other and arranged at lateral sides of an inner surface of the top side 121. Each first supporting post 1211 has a first receiving hole (not figured) therein.

The top wall 111 of the base portion 11 of the first shield part 1 defines a first channel 1111 arranged in a middle section thereof and a lower second channel 1114 in front of and communicating with the first channel 1111. The first and second channels 1111, 1114 are both formed on a top surface of the top wall 111 of the base portion 11. It should be noted that the top surface of the top wall 111 of the base portion 11 of the first shield part 1 can be seen as the first top surface 1011 of the base portion 101 of the housing 10. In addition, a pair of first grooves 1112 are located in the middle section of the top wall 111 and further communicate with the first channel 1111. Two second grooves 1113 are in front of the first grooves 1112 and also communicate with the first channel 1111. A receiving room 1115 is recessed downwardly from the top surface of a front section of the top wall 111 and communicates with the first channel portion 1114. It should be noted that the second channel 1114 can also be seen as the receiving room 1115. A pair of protrusions 1116 are formed on a front side of a bottom surface of the receiving room 1115. The bottom surface of the receiving room 115 can be defined as a third top surface of the base portion 101 of the housing 10. And a protruding piece 1118 is formed on a rear side of a bottom surface of the receiving room 1115. A pair of slits 1117 extend downward from the top surface of the top wall 111 and communicate with the receiving room 1115. The pair of slits 1117 are disposed at two sides of the receiving room 1115.

Referring to FIGS. 1 to 3, the second shield part 2 comprises a second base portion 21 and a second mating portion 22 extending forwardly from a front edge of the second base portion 21. The second base portion 21 has a bottom wall 211, a pair of side walls 212, 213 and a rear wall 214 extending upwardly from lateral edges and rear edge of the bottom wall 211. Four semicircular through holes 2141 extending in a front to rear direction are defined in the rear wall 214 and arranged in a row along transversal direction. Further, a recess 2142 is formed in each semicircular through hole 2141. The second mating portion 22 has a bottom side 221 and a pair of flanges 222, 223 extending upward from two lateral edges of the bottom side 221. Two pair of second supporting posts 2211 are respectively arranged at lateral sides of the bottom side 221. Each second supporting post 2211 defines a second receiving hole therein.

Referring to FIGS. 1 to 2, the pair of PCBs 3 includes a first PCB 3*a* and a second PCB 3*b*. A structure of the first PCB 3*a* is the same with a structure of the second PCB 3*b*. Each of the first and second PCBs 3*a*, 3*b* includes a substrate 30 defining a middle section 32, a narrower front section 31 and a broader rear section 32. A group of first conductive pads 311 are arranged on the front section 31 of each PCB 3 to form a first mating interface and a set of second conductive pads 331 are arranged on the rear section 33 of each PCB 3 to form a first mounting portion. A distance between two adjacent first conductive pads 311 is narrower than a distance between two adjacent second conductive pads 331. Two pair of through holes 321 are respectively defined in lateral sides of the middle section 32 of each PCB 3.

Referring to FIGS. 1 to 2, the spacer 4 defines an upper surface 402 and an opposite lower surface 401. Two pair of positioning posts 403 are respectively formed on the upper surface 402 and lower surface 401 of the spacer 4 for cooperating with the through holes 321 formed on the PCBs 3*a*, 3*b*, and first and second receiving holes (not figured) respectively formed in the first and second supporting posts 1211, 2211.

Figure 6:
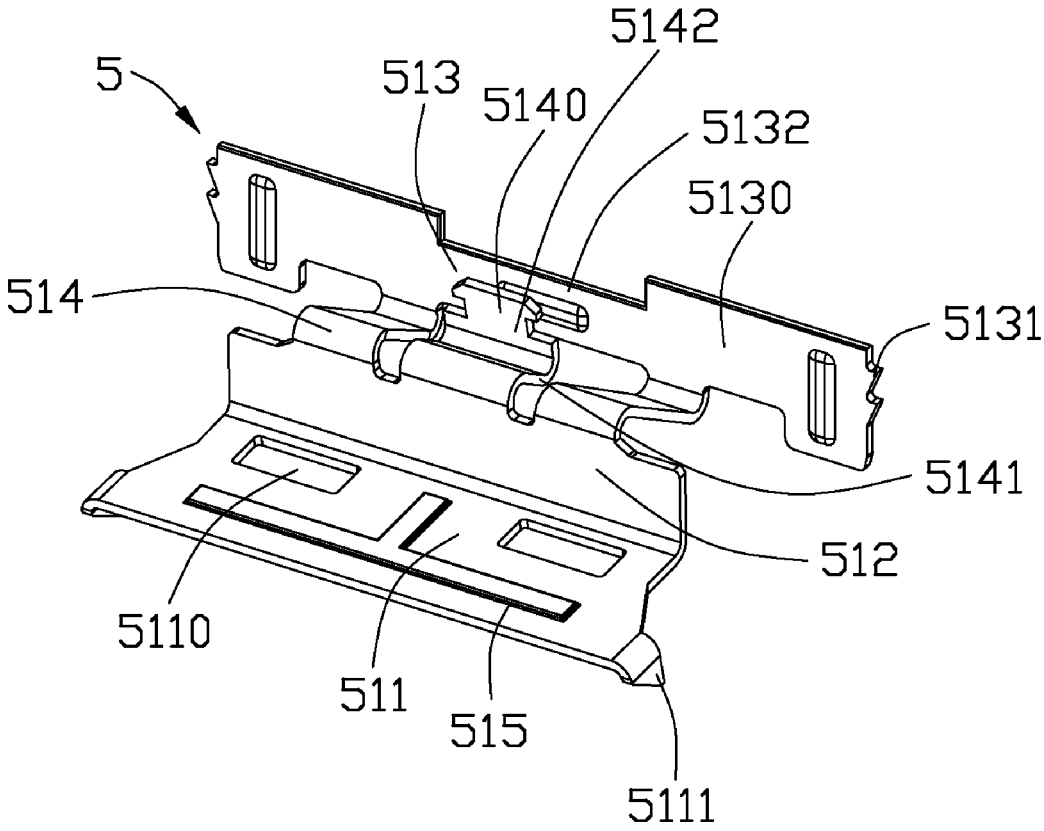
FIG. 6 is perspective view of a latching member of the cable assembly.

Referring to FIGS. 1 to 2 and FIG. 6, an optional latching mechanism 5 is assembled to the housing 10 of the cable assembly 100. The latching mechanism 5 includes a latching member 51, a pulling member 52 cooperated with the latching member 51 and a pulling tape 53 attached to a rear portion of the pulling member 52. The pulling member 52 has a main body 521 which can be received into the first channel 1111, a pair claw-shaped spring members 522 arranged at lateral sides of a front segment of the main body 521 and received in the first grooves 1112, a pair of stoppers 523 disposed in front of the pair of claw-shaped spring members 522 and arranged at the lateral sides of the main body 521 and received in the second grooves 1113 and a cooperating portion 524 formed at a front end thereof which can be entered into the receiving room 1115 of the first shield part 1. An aperture 5240 is formed in the cooperating portion 524.

Referring to FIGS. 1 to 2 and in conjunction with FIG. 6, the latching member 51 has a main section 511, a connecting section 512 extending upward form a rear end of the main section 511, an engaging section 513 engaged with the housing 10, an inclined section 514 connected with the connecting section 512 and the engaging section 513. The connecting section 512 and the engaging section 513 are respectively located on two paralleled vertical planes. An actuating section 5140 extends rearward and upward from a connection between the connecting section 512 and the inclined section 514. The actuating section 5140 has a slant segment 5141 extending along the inclined section 514 and a locking segment 5142 extending upward form the slant segment 5141. The locking segment 5142 is a tab and can pass through the aperture 5240 formed on the cooperating portion 524 of the pulling member 52 and locked with the pulling member 52. The main section 511 defines a pair of hooks 5111 at two sides thereof and a pair of openings 5110 at a middle portion thereof. A front end of the latching member 51 can be defined as a latching section 515 of the latching member 51. The engaging section 513 defines a base segment 5132 and a pair of side segments 5130 which can be received into the corresponding slits 1117 formed on the first top surface 1011 of the base portion 101 of the housing 10. Each side segment 5130 defines a plurality of barbs 5131 for engaging the latching member 51 to the housing 10.

Referring to FIGS. 1 to 2, the conductive shell 6 comprises a body portion 60 and a slant tab 404 extending forward and downward from a front edge of the body portion 40. In addition, a pair of first and second screws 62 are assembled to the cable assembly 100 to interconnect with the conductive shell 6, the first shield part 1 and the second shield part 2.

Referring to FIGS. 1 to 2, each of the cables 7 includes a number of wires 71 and an insulated jacket 70 enclosing thereon. A circular-shaped ring member 72 is formed around the insulated jacket 70 and can be disposed into the semicircular through holes 1141, 2141 respectively formed in the first and second shield parts 1, 2. The cables 7 can be arranged into an upper and a lower rows. A wire management member 8 is integrated formed around the number of wires 71 to manage the number of wires 71.

Referring to FIGS. 1 to 2, the cable assembly 100 of the present invention may have a gasket 9 assembled to the housing 10 for reducing the Electro Magnetic Interference (EMI) in the signal transmission. The gasket 9 is a rectangular frame which can be mounted to an outer periphery of the mating portion 102 of the housing 10. The gasket 9 defines a cutout 91 thereon for a portion of the latching member 51 passing through.

When assembly, firstly the wires 71 of the cables 7 are soldered to the second conductive pads 331 of the first and second PCBs 3*a*, 3*b*. Then the spacer 4 is arranged between the first and second PCBs 3*a*, 3*b*, thus, the positioning posts 403 formed on the upper and lower surfaces 402, 401 of the spacer 4 respectively passes through the corresponding through holes 321 formed on the first and second PCBs 3*a*, 3*b* to make the first and second PCBs 3*a*, 3*b* and the spacer 4 assembled together.

Secondly, the PCBs 3*a*, 3*b* and the spacer 4 are together assembled to the second shield part 2, each positioning post 403 formed on the lower surface 401 of the spacer 4 has a free end received into a receiving hole (not figured) formed in each second supporting post 2211. At the same time, the cables 7 are supported by the rear wall 214 of the second shield part 2 and extends into the second shield part 2 through the semicircular through holes 2141, and a lower portion of each ring member 72 is located into a recess 2142 formed in each semicircular through hole 2141 of the rear wall 214.

Thirdly, the first shield part 1 is assembled to the second shield part 2 to form a housing 10, thus, the first and second PCBs 3*a*, 3*b* and the spacer 4 are enclosed into the housing 10, each positioning post 403 formed on the upper surface 402 of the spacer 4 has a free end received into a receiving hole (not figured) formed in each first supporting post 1211. And the ring member 72 is fully received into the recesses 1142, 2142 respectively formed in the rear walls 114, 214 of the first and second shield parts 1, 2. Obviously, the number of first and second conductive pads 311, 331 are located in the housing 10 through the first and second PCBs 3*a*, 3*b* disposed in the housing 10.

Fourthly, the latching member 51 is received into the receiving room 1115 of the first shield part 1 of the housing 10 and engaged with the housing 10. The base segment 5132 of the engaging section 513 is disposed between the protruding piece 1118 and a rear surface of the receiving room 1115 in a longitudinal direction, the pair of side segments 5130 of the engaging section 513 are received into the pair of slits 1117 and engaging with the housing 10. The latching section 515 of the latching member 51 is located on the top of the second top surface 1021 of the mating portion 102 of the housing 10. As a result, the latching portion 515 is cantilevered from the engaging portion 513 of the latching member 51. The connecting portion 512 and the inclined portion 514 are located on the top of the bottom surface of the receiving room 1115.

Fifthly, the pulling member 52 is attached to the first top surface 1011 of the base portion 101 of the housing 10 and cooperated with the latching member 51. Thus, the locking segment 5142 of the actuating section 5140 pass through the aperture 5240 formed on the cooperating portion 524 of the pulling member 52. Thus, the latching member 51 and the pulling member 52 are interlocked with each other. It is clearly that the pulling member 52 is disposed on the top of latching member 51. Then, the pulling tape 53 is attached to the rear end of the pulling member 52. When a rearward pulling force exerts on the pulling member 52 or the pulling tape 53, a pair of claw-shaped spring members 522 and a pair of stoppers 523 are respectively sided in the first and second grooves 1112, 1113 along a front to rear direction, the pulling member 52 is also moved rearward. Thus, the actuating section 5140 of the latching member 51 is also pulled backward by a rearward movement from the pulling member 52, simultaneously, the main portion 511 of the latching member 51 will be raised up easily. When a pulling force exerted on the pulling member 52 is removed, the latching member 51 will be resumed to an original state. So, the interconnection between the pulling member 52 and the latching member 51 is reliable and the cooperation between the pulling member 52 and the latching member 51 is simple.

Six, the conductive shell 6 is assembled to the first top surface 1011 of the base portion 101 of the housing 10, and then a pair of first and second screws 62 are assembled to the cable assembly 100 to interconnect with the conductive shell 6, the first shield part 1 and the second shield part 2.

At last, a gasket 9 is assembled to the housing 10. The gasket 9 is mounted to an outer periphery of the mating portion 102 of the housing 10 and attached to a front surface of the base portion 101 of the housing 10.

After the above assembling steps, the entire process of assembling the cable assembly 100 is finished.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a housing formed by a base portion having a first top surface and a mating portion having a second top surface, and the housing having a receiving space therein;

a plurality of conductive contacts retained in the housing;

a cable entered into the receiving space and electrically connected with the conductive contacts;

a pulling member moveable relative to the housing in a horizontal direction, and comprising a cooperating portion at a front end thereof; and a latching member cooperated with the pulling member and assembled to the housing for latching with a complementary connector, the latching member comprising an engaging section assembled to the housing, a latching section disposed on the top of the base portion and an actuating section disposed between the engaging section and the latching section, the actuating section located below the interconnected with the cooperating portion and capable of being actuated by the cooperating portion of the pulling member.

2. The cable assembly as recited in claim 1, wherein the actuating section of the latching member defines a free end locking segment thereof, the cooperating portion of the pulling member defines an aperture therein, and the locking segment passes through the aperture and locks with the cooperating portion of the pulling member.

3. The cable assembly as recited in claim 1, wherein the cable assembly further comprises a pair of printed circuit boards received into the housing, and wherein the contacts are first and second conductive pads formed on front and rear ends of each printed circuit board.

4. The cable assembly as recited in claim 3, wherein the cable assembly further comprises a spacer sandwiched between the pair of printed circuit boards.

5. The cable assembly as recited in claim 1, wherein the housing defines a first shield part and a second shield part assembled to the first shield part.

6. The cable assembly as recited in claim 1, wherein a receiving room is formed on the first top surface of the base portion of the housing, the latching member is disposed in the receiving room, the cooperating portion of the pulling member is supported by the first top surface and extended into the receiving room, and interconnected with the latching member.

7. The cable assembly as recited in claim 1, wherein the latching member further defines a connecting section and an inclined section defined between the latching section and the engaging section, the connecting section and the engaging section are both located on two paralleled vertical planes.

8. The cable assembly as recited in claim 7, wherein the actuating section has a slant segment extending along the inclined section and a locking segment extending upward form a rear end of the slant segment, the locking segment disposed between the connecting section and the engaging section in a front to rear direction.

9. The cable assembly as recited in claim 1, wherein the cable assembly further comprises a conductive shell to the housing.

10. The cable assembly as recited in claim 1, wherein the cable assembly further comprises a gasket mounted to an outer periphery of the mating portion of the housing.

11. A cable assembly, comprising:

a housing comprising a base portion and a mating portion, the base portion having a first and third top surface lower than the first surface, the mating portion having a second top surface;

a plurality of conductive contacts located in the housing;

a cable electrically connected with the conductive contacts;

a pulling member disposed on the first top surface of the housing and moveable relative to the housing in a horizontal direction, and having a cooperating portion at a front free end thereof;

a latching member mainly disposed on the third top surface of the housing, and assembled to the housing and interconnected with the pulling member, the latching member comprising an engaging section assembled to the housing, a latching section disposed on the top of the second top surface of the housing and an actuating section disposed between the latching portion and the engaging portion and actuated by the cooperating portion of the pulling member, a free end of the actuating section pierced through the cooperating portion to achieve an connection between the latching member and the pulling member.

12. The cable assembly as recited in claim 11, wherein a pair of vertical slits are formed on the first top surface, two sides of the engaging section of the latching member are received into the pair of vertical slits.

13. The cable assembly as recited in claim 11, wherein the free end of the actuating section pierces through the cooperating portion of the pulling member along a down to up direction.

14. The cable assembly as recited in claim 11, wherein the cooperating portion of the pulling member is disposed on the top of the actuating section of latching member.

15. The cable assembly as recited in claim 11, wherein the cable assembly further comprises a conductive shell assembled to the housing.

16. A cable connector assemble comprising:

a casing defining a mating port forwardly communicating with an exterior;

a plurality of contacts disposed in the mating port;

a metallic latch including a retention section secured to an exterior face of the casing and a latch section located in front of the retention section and connected to said retention section via a connection section under a cantilevered manner, a hook formed at a front free end of the latching section, an actuation section located between the retention section and the latch section in a front-to-back direction; and a pulling member having a front portion linked to the actuation section, said pulling section extending rearwardly from the front portion along said front-to-back direction with an operation area at a rear end; wherein the pulling member is constantly secured to a specific position of the actuation section without relative movement along said front-to-back direction so that rearwardly movement of the pulling member results in deflection in a direction perpendicular to said front-to-back direction.

17. The cable connector assembly as claimed in claim 16, wherein the latch defines a supporting area around an upper side of the retention section to support movement of the pulling member.

18. The cable connector assembly as claimed in claim 16, wherein the front portion of said pulling member is located above the latch.

19. The cable connector assembly as claimed in claim 16, wherein the connection section is located by two sides of said actuation section.

20. The cable connector assembly as claimed in claim 16, wherein the actuation section extends from a mid-point of the latch in said front-to-back direction.

* * * * *